US009761975B1

(12) United States Patent
Wang et al.

(10) Patent No.: US 9,761,975 B1
(45) Date of Patent: Sep. 12, 2017

(54) CONNECTOR MODULE

(71) Applicant: P-TWO INDUSTRIES INC., Taoyuan (TW)

(72) Inventors: Chien-Chun Wang, Taoyuan (TW); Tung-Ching Kuan, Taoyuan (TW)

(73) Assignee: P-TWO INDUSTRIES INC., Taoyuan (TW)

( * ) Notice: Subject to any disclaimer, the term of this patent is extended or adjusted under 35 U.S.C. 154(b) by 0 days.

(21) Appl. No.: 15/293,280

(22) Filed: Oct. 14, 2016

(30) Foreign Application Priority Data

Aug. 12, 2016 (TW) ..... 105212389 U

(51) Int. Cl.

| | |
|---|---|
| ***H01R 12/00*** | (2006.01) |
| ***H01R 12/73*** | (2011.01) |
| ***H01R 12/71*** | (2011.01) |
| ***H01R 12/79*** | (2011.01) |

(52) U.S. Cl.
CPC ..... *H01R 12/737* (2013.01); *H01R 12/716* (2013.01); *H01R 12/79* (2013.01)

(58) Field of Classification Search
CPC ..... H01R 12/737; H01R 12/716; H01R 12/79
USPC ..... 439/81, 65, 67, 660, 680
See application file for complete search history.

(56) References Cited

U.S. PATENT DOCUMENTS 5,240,420 A * 8/1993 Roberts ..... H01R 12/714 439/493
5,816,842 A * 10/1998 Thantrakul ..... G11B 33/122 439/374
6,302,744 B1 * 10/2001 Nomura ..... H01R 13/64 439/680
6,315,616 B1 * 11/2001 Hayashi ..... H01R 12/89 439/108
7,367,812 B2 * 5/2008 Shih ..... H01R 13/6275 439/374
8,242,374 B2 * 8/2012 Chuo ..... H05K 1/118 174/250
8,529,282 B1 * 9/2013 Westman ..... H01R 12/737 439/345
8,758,037 B2 * 6/2014 Chang ..... H01R 13/62 439/354

(Continued)

FOREIGN PATENT DOCUMENTS

JP 2003100392 A 4/2003
JP 200612717 A 1/2006

*Primary Examiner* — Abdullah Riyami
*Assistant Examiner* — Nader Alhawamdeh
(74) *Attorney, Agent, or Firm* — Winston Hsu

(57) ABSTRACT

A connector module includes a board connector and a cable connector. The board connector includes a board connecting body whereon a slot is formed, conductive terminals disposed on the board connecting body and extending into the slot, and two metal pads disposed on two sides of the board connecting body and each having a resilient buckle. The cable connector includes a cable connecting body including an installation portion and two engaging portions, and a flexible transmission unit installed in the installation portion. Contacts are disposed on a front end of the flexible transmission unit. The front end of the flexible transmission unit is inserted into the slot, the conductive terminals contact with the contacts, and the resilient buckles engage with the engaging portions when the cable connector is connected with the board connector.

20 Claims, 6 Drawing Sheets

(56) References Cited

U.S. PATENT DOCUMENTS

| | | | | |
|---|---|---|---|---|
| 2006/0089011 | A1* | 4/2006 | Marshall | H01R 12/716 439/65 |
| 2009/0233460 | A1* | 9/2009 | Huang | H01R 31/06 439/65 |
| 2015/0270645 | A1* | 9/2015 | Sato | H01R 13/6471 439/651 |

* cited by examiner

CONNECTOR MODULE

BACKGROUND OF THE INVENTION

1. Field of the Invention

The present invention relates to a connector module, and more particularly, to a connector module with enhanced signal transmission stability.

2. Description of the Prior Art

With rapid development of electronic industries and multimedia application, various male and female connectors are utilized for data transmission between electrical appliances. Furthermore, automobiles are popular transportation facilities and equipped more and more electronic devices to achieve convenience of use and entertainment in the automobiles, such as audio and video appliances, display panels, MP3 player adapters or chargers for electronic products. However, the automobile electronic devices installed inside cars have different utilization conditions from ones of normal electronic devices. Generally, there is no fastening mechanism adapted for fastening a plug connector and a socket connector of a conventional automobile connector module, resulting in insufficient fastening strength as the plug connector is plugged into the socket connector. The plug connector and the socket connector might separate from each other as a cable connected to the plug connector is dragged by an external force, which makes poor connection and reduces signal transmission stability between the plug connector and the socket connector of the conventional automobile connector module.

SUMMARY OF THE INVENTION

Therefore, an objective of the present invention is to provide a connector module with enhanced signal transmission stability, for solving the aforementioned problem that there is no fastening mechanism adapted for fastening a plug connector and a socket connector of a conventional automobile connector module, which results in insufficient fastening strength as the plug connector is plugged into the socket connector, makes poor connection and reduces signal transmission stability between the plug connector and the socket connector of the conventional automobile connector module.

In order to achieve the aforementioned objective, the present invention discloses a connector module including a board connector and a cable connector. The board connector includes a board connecting body whereon a slot is formed, a plurality of conductive terminals disposed on the board connecting body and extending into the slot, and at least one metal pad disposed on at least one side of the board connecting body. The at least one metal pad includes a resilient buckle. The cable connector includes a cable connecting body including an installation portion and at least one engaging portion, and a flexible transmission unit installed in the installation portion. A plurality of contacts is disposed on a front end of the flexible transmission unit. The front end of the flexible transmission unit is inserted into the slot, the plurality of conductive terminals contacts with the plurality of contacts, and the resilient buckle of the at least one metal pad engages with the at least one engaging portion when the cable connector is connected with the board connector.

The connector module of the present invention utilizes the resilient buckle of the metal pad of the board connector to engage with the engaging portion on the cable connector when the cable connector is connected with the board connector, so as to fasten the cable connector with the board connector firmly. It achieves the stable electrical connection of the plurality of conductive terminals and the plurality of contacts and ensures signal transmission stability between the cable connector and the board connector of the present invention.

These and other objectives of the present invention will no doubt become obvious to those of ordinary skill in the art after reading the following detailed description of the preferred embodiment that is illustrated in the various figures and drawings.

DETAILED DESCRIPTION

In order to illustrate technical specifications and structural features as well as achieved purposes and effects of the present invention, relevant embodiments and figures are described as follows.

Figure 1:
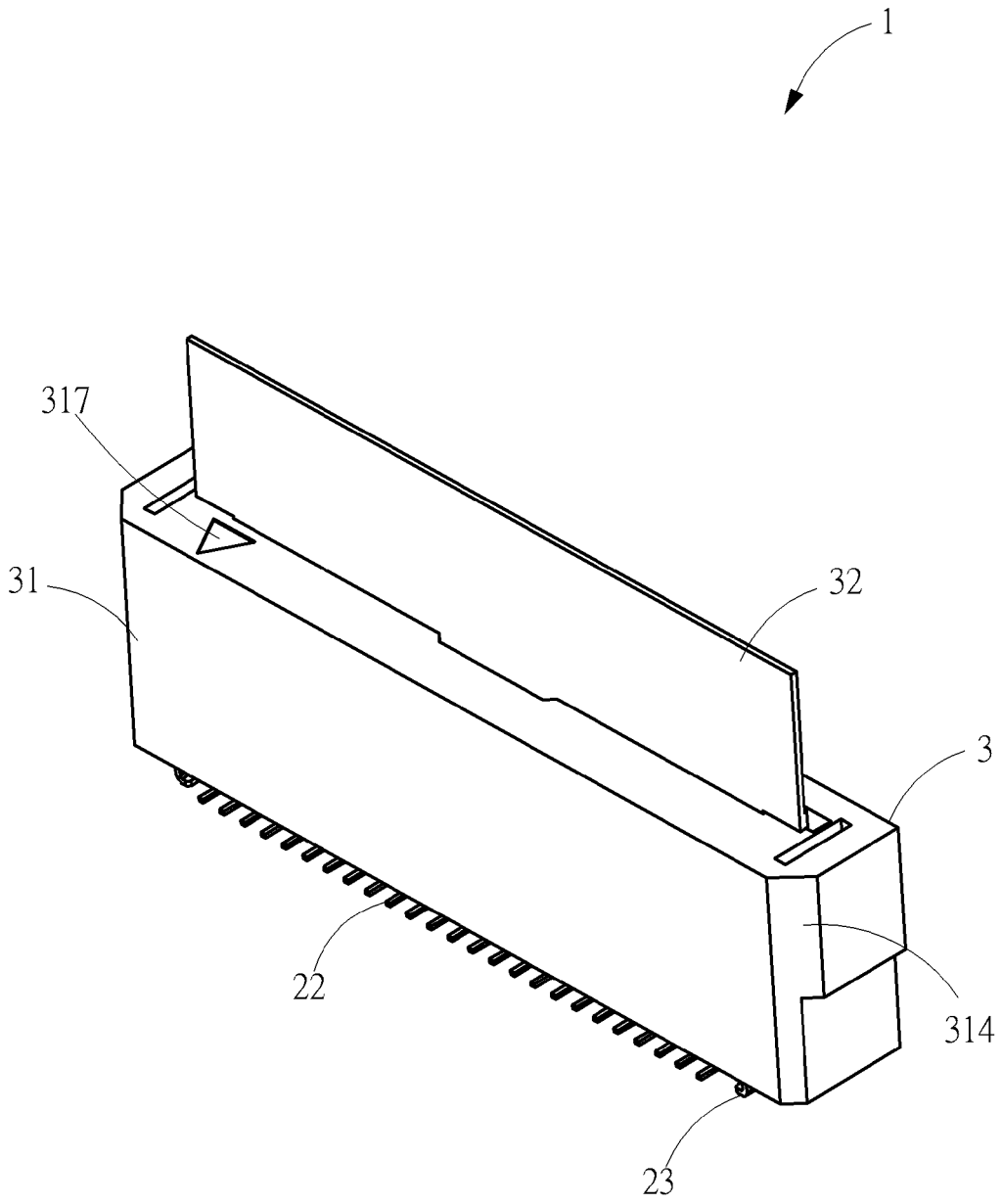
FIG. 1 is a schematic diagram of a connector module according to an embodiment of the present invention.
Figure 2:
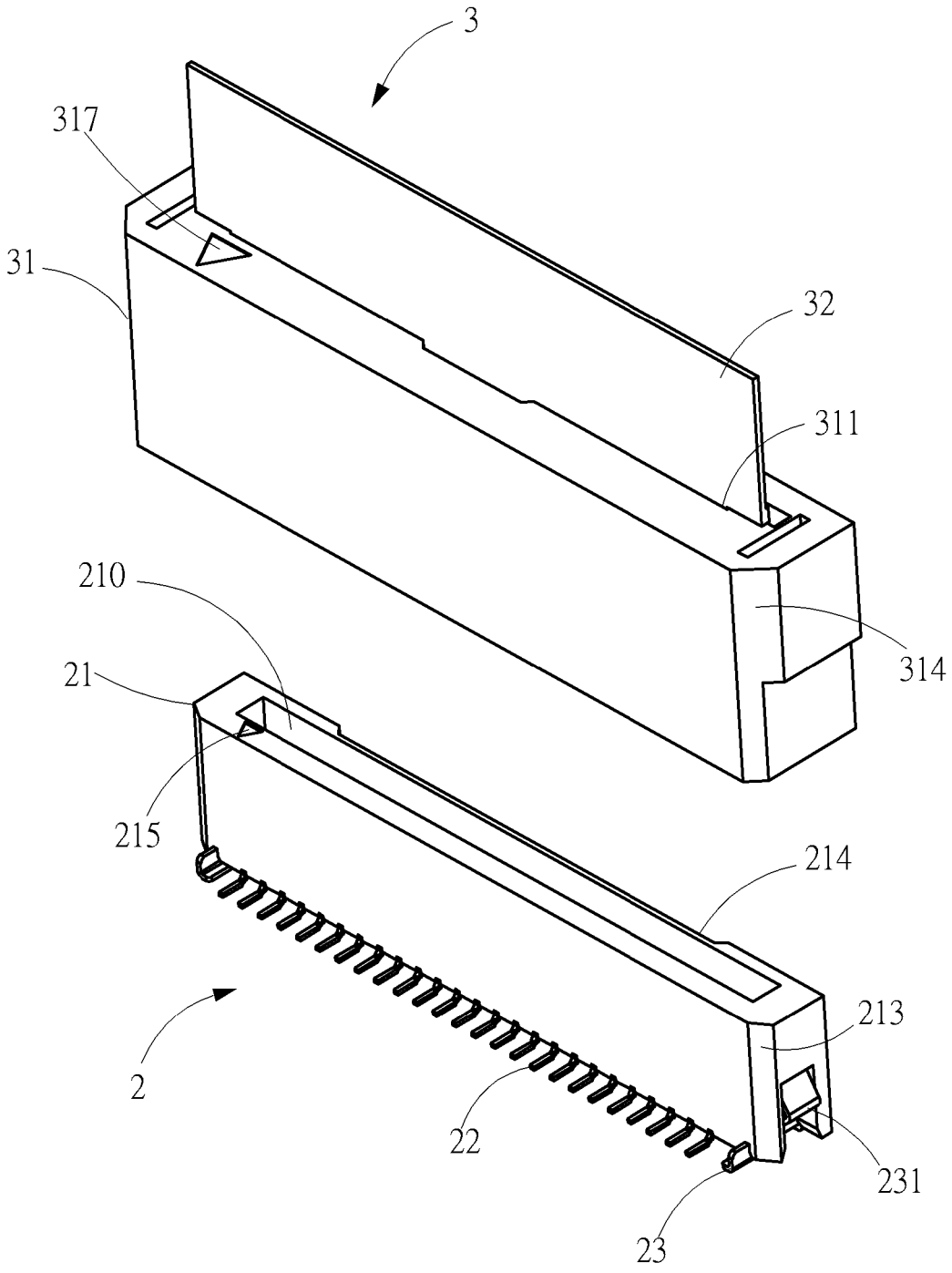
FIG. 2 is an exploded diagram of the connector module according to the embodiment of the present invention.
Figure 3:
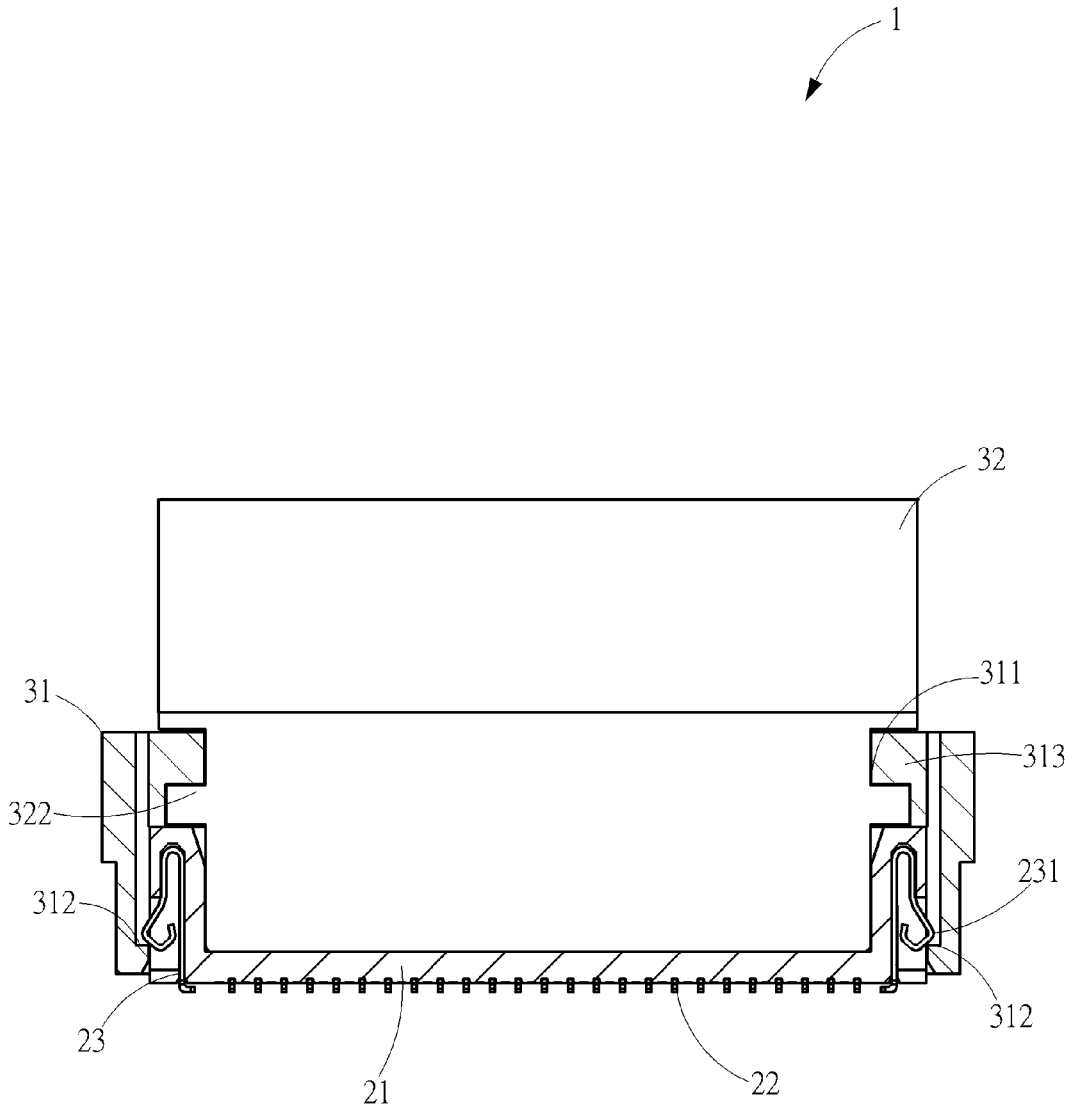
FIG. 3 is a sectional diagram of the connector module according to the embodiment of the present invention.
Figure 4:
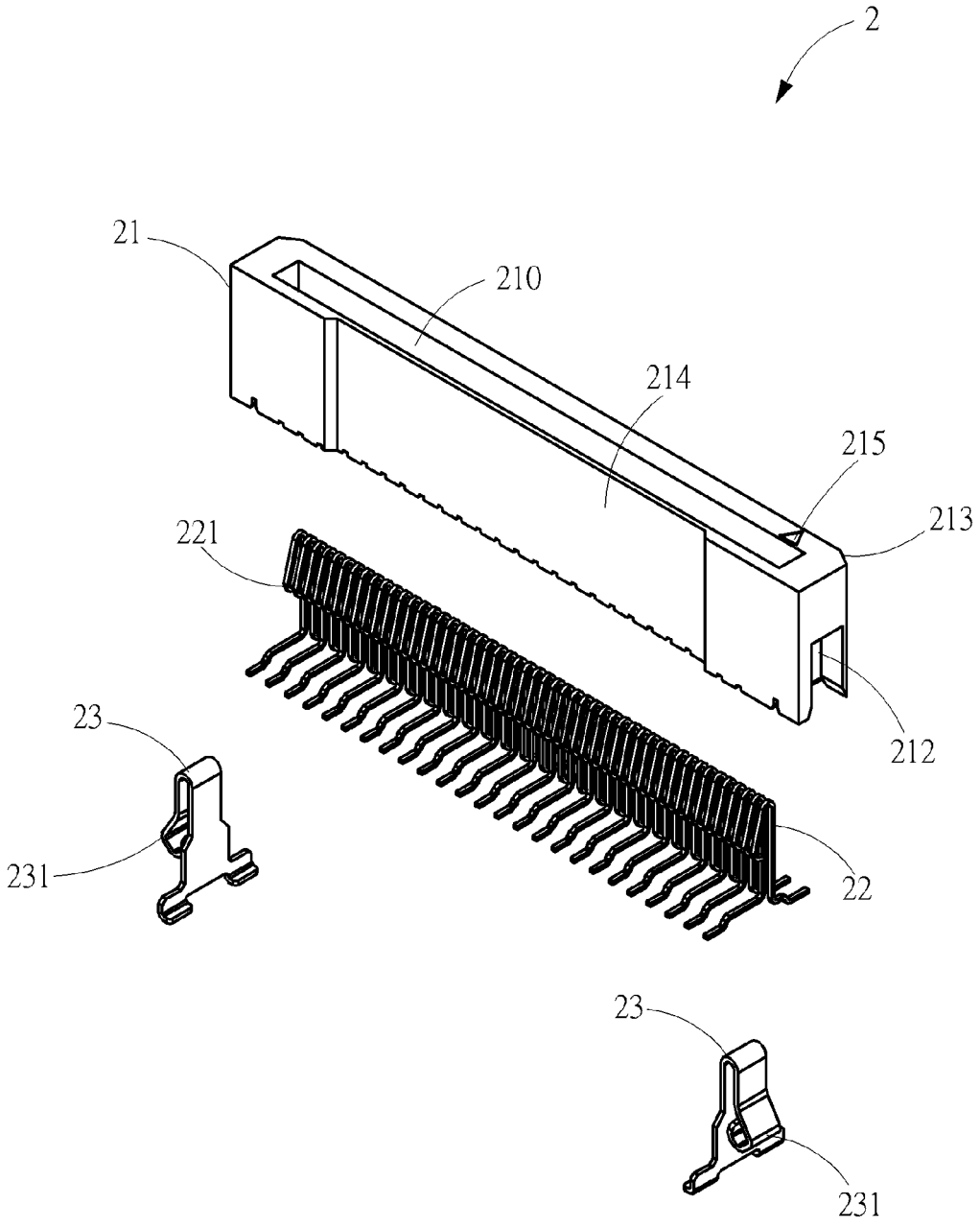
FIG. 4 is an exploded diagram of a board connector of the connector module according to the embodiment of the present invention.
Figure 5:
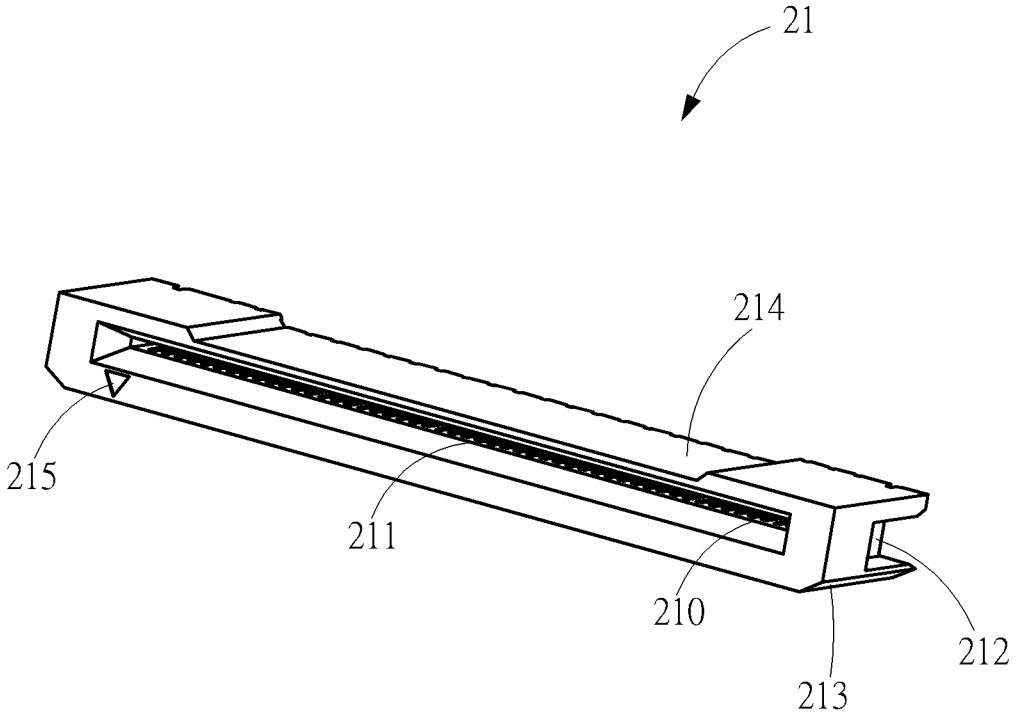
FIG. 5 is a schematic diagram of a board connecting body of the board connector according to the embodiment of the present invention.
Figure 6:
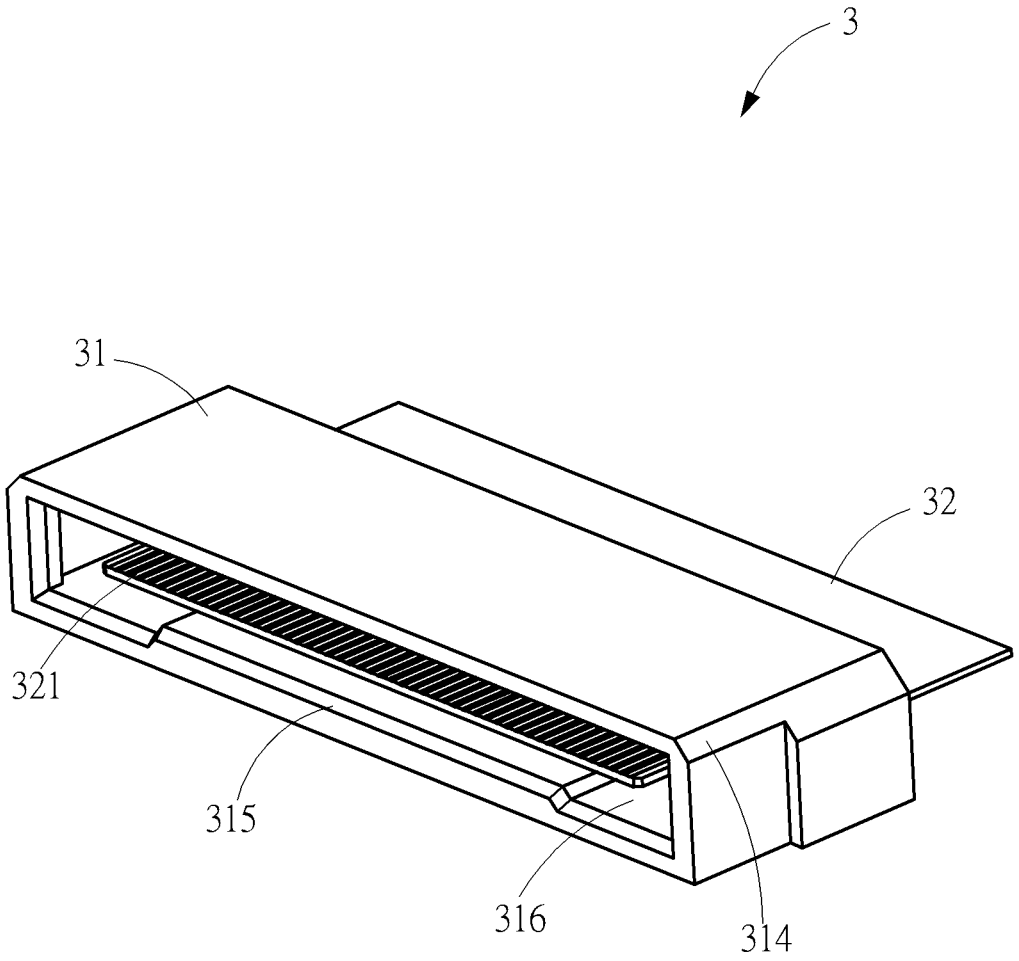
FIG. 6 is a schematic diagram of a cable connector of the connector module according to the embodiment of the present invention.

Please refer to FIG. 1 to FIG. 6. FIG. 1 is a schematic diagram of a connector module 1 according to an embodiment of the present invention. FIG. 2 is an exploded diagram of the connector module 1 according to the embodiment of the present invention. FIG. 3 is a sectional diagram of the connector module 1 according to the embodiment of the present invention. FIG. 4 is an exploded diagram of a board connector 2 of the connector module 1 according to the embodiment of the present invention. FIG. 5 is a schematic diagram of a board connecting body 21 of the board connector 2 according to the embodiment of the present invention. FIG. 6 is a schematic diagram of a cable connector 3 of the connector module 1 according to the embodiment of the present invention. The connector module 1 includes the board connector 2 which can be welded on a circuit board (not shown in figures), and the cable connector 3 for assembling with the board connector 2.

The board connector 2 includes a board connecting body 21, a plurality of conductive terminals 22, and a pair of metal pads 23. A slot 210 is formed on the board connecting body 21, and a plurality of terminal grooves 211 is also formed on the board connecting body 21 and communicated with the slot 210. Two inserting slots 212 are formed on two sides of the board connecting body 21, respectively. The plurality of conductive terminals 22 is disposed on the board connecting body 21 and extends into the slot 210. Specifically, the plurality of conductive terminals 22 is installed inside the plurality of terminal grooves 221, and a contacting portion 221 of each conductive terminal 22 extends into the slot 210. The two metal pads 23 are assembled inside the two inserting slots 212 formed on the two sides of the board connecting body 21, respectively. Each metal pad 23 includes a resilient buckle 231 protruding out of the board connecting body 21.

The cable connector 3 includes a cable connecting body 31 and a flexible transmission unit 32. The cable connecting body 31 includes an installation portion 311 and two engaging portions 312 disposed on two sides of the installation portion 311 of the cable connecting body 31. The flexible transmission unit 32 is installed in the installation portion 311 of the cable connecting body 31, so as to fix the flexible transmission unit 32 on the cable connecting body 31. In this embodiment, the flexible transmission unit 32 can be a flexible flat cable, and a plurality of contacts 321 is disposed on a front end of the flexible transmission unit 32. The installation portion 311 of the cable connecting body 31 can be a slit structure wherethrough the flexible transmission unit 32 is inserted and fastened, and a positioning portion 313 is disposed in the slit structure. Two interfering portions 322 are disposed on two sides of the flexible transmission unit 32 respectively and for interfering with the positioning portion 313, so as to fix the flexible transmission unit 32 in the cable connecting body 31. Furthermore, a groove 316 is formed inside the cable connecting body 31 and communicated with the installation portion 311, i.e. the slit structure, and the plurality of contacts 321 disposed on the front end of the flexible transmission unit 32 is located in the groove 316, so that the cable connecting body 31 can surround the plurality of contacts 321 for preventing the plurality of contacts 321 from being hit by external objects. That is, when the cable connector 3 is connected with the board connector 2, the board connecting body 21 of the board connector 2 is inserted into the groove 316 of the cable connector 3, so that the cable connecting body 31 can surround or cover the board connecting body 21 and the resilient buckle 231.

When the cable connector 3 is connected with the board connector 2, the front end of the flexible transmission unit 32 is inserted into the slot 210 and the plurality of conductive terminals 22 contacts with the plurality of contacts 321. At this time, the resilient buckle 231 of the metal pad 23 engages with the corresponding engaging portion 312 of the cable connecting body 31. In this embodiment, the resilient buckle 231 can be a hook-shaped spring protruding from the board connecting body 21, the engaging portion 312 can be a sunken portion disposed on the cable connecting body 31. The sunken portion is disposed in the groove 316 and corresponding to the hook-shaped spring, and the hook-shaped spring engages inside the sunken portion when the cable connector 3 is connected with the board connector 2, so as to fasten the cable connector 3 with the board connector 2.

In this embodiment, at least one inclined plane 213 is formed on an outer surface of the board connecting body 21 so that the board connecting body 21 is formed in an asymmetric shape. Similarly, another inclined plane 314 is formed on an outer surface of the cable connecting body 31 and corresponding to the inclined plane 213 on the outer surface of the board connecting body 21, so as to achieve fool-proofing function and prevent occurrence of incorrect insertion. Besides, at least one sunken plane 214 is formed on an outer surface of the board connecting body 21 so that the board connecting body 21 is formed in an asymmetric shape. Similarly, a protrusion 315 is disposed in the groove 316 formed inside the cable connecting body 31 and corresponding to the sunken plane 214, and the sunken plane 214 and the protrusion 315 engage with each other when the board connecting body 21 of the board connector 2 is inserted into the groove 316 of the cable connector 3 so that the cable connector 3 is connected with the board connector 2, so as to achieve the fool-proofing function.

Besides, the slot 210 is formed on a top of the board connecting body 21, at least one symbol 215 is marked on the top of the board connecting body 21 and located in a position adjacent to the slot 210, and another symbol 317 is marked on the cable connecting body 31 and corresponding to the symbol 215, for achieving the fool-proofing function by another way. The symbols 215, 317 can be formed in a triangular shape. When it is desired to connect the cable connector 3 with the board connector 2, the symbol 317 marked on the cable connecting body 31 needs to be aimed at the symbol 215 marked on the top of the board connecting body 21 for correct insertion, so as to achieve the fool-proofing function and prevent occurrence of incorrect insertion.

In contrast to the prior art, the connector module of the present invention utilizes the resilient buckle of the metal pad of the board connector to engage with the engaging portion on the cable connector when the cable connector is connected with the board connector, so as to fasten the cable connector with the board connector firmly. It achieves the stable electrical connection of the plurality of conductive terminals and the plurality of contacts and ensures signal transmission stability between the cable connector and the board connector of the present invention.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A connector module comprising:

a board connector comprising:

a board connecting body whereon a slot is formed;

a plurality of conductive terminals disposed on the board connecting body and extending into the slot; and at least one metal pad disposed on at least one side of the board connecting body, the at least one metal pad comprising a resilient buckle; and a cable connector comprising:

a cable connecting body comprising an installation portion and at least one engaging portion; and a flexible transmission unit installed in the installation portion, a plurality of contacts being disposed on a front end of the flexible transmission unit;

wherein the front end of the flexible transmission unit is inserted into the slot, the plurality of conductive terminals contacts with the plurality of contacts, and the resilient buckle of the at least one metal pad engages with the at least one engaging portion when the cable connector is connected with the board connector.

2. The connector module of claim 1, wherein a plurality of terminal grooves is formed on the board connecting body and communicated with the slot, the plurality of conductive terminals is installed inside the plurality of terminal grooves, at least one inserting slot is formed on the at least one side of the board connecting body, and the at least one metal pad is assembled inside the at least one inserting slot.

3. The connector module of claim 1, wherein the board connector comprises two metal pads disposed on two sides of the board connecting body.

4. The connector module of claim 3, wherein the resilient buckle is a hook-shaped spring protruding from the board connecting body, the engaging portion is a sunken portion disposed on the cable connecting body, and the hook-shaped spring engages inside the sunken portion when the cable connector is connected with the board connector.

5. The connector module of claim 3, wherein the board connector comprises two inserting slots formed on the two sides of the board connecting body, and the two metal pads are assembled inside the two inserting slots, respectively.

6. The connector module of claim 5, wherein the resilient buckle is a hook-shaped spring protruding from the board connecting body, the engaging portion is a sunken portion disposed on the cable connecting body, and the hook-shaped spring engages inside the sunken portion when the cable connector is connected with the board connector.

7. The connector module of claim 6, wherein a groove is formed inside the cable connecting body, the sunken portion is disposed in the groove and corresponding to the hook-shaped spring, and the board connecting body of the board connector is inserted into the groove of the cable connector when the cable connector is connected with the board connector.

8. The connector module of claim 7, wherein the plurality of contacts disposed on the front end of the flexible transmission unit is located in the groove so that the cable connecting body surrounds the plurality of contacts.

9. The connector module of claim 7, wherein the board connector is inserted into the groove of the cable connector so that the cable connecting body surrounds the board connecting body and the two hook-shaped springs when the cable connector is connected with the board connector.

10. The connector module of claim 7, wherein at least one sunken plane is formed on an outer surface of the board connecting body so that the board connecting body is formed in an asymmetric shape, a protrusion is disposed in the groove and corresponding to the at least one sunken plane, and the at least one sunken plane and the protrusion engage with each other when the board connecting body of the board connector is inserted into the groove of the cable connector.

11. The connector module of claim 1, wherein the cable connecting body comprising two engaging portions disposed on two sides of the installation portion.

12. The connector module of claim 1, wherein at least one inclined plane is formed on an outer surface of the board connecting body so that the board connecting body is formed in an asymmetric shape.

13. The connector module of claim 12, wherein another inclined plane is formed on an outer surface of the cable connecting body and corresponding to the at least one inclined plane on the outer surface of the board connecting body.

14. The connector module of claim 1, wherein at least one sunken plane is formed on an outer surface of the board connecting body so that the board connecting body is formed in an asymmetric shape.

15. The connector module of claim 14, wherein a groove is formed inside the cable connecting body, a protrusion is disposed in the groove and corresponding to the at least one sunken plane, and the at least one sunken plane and the protrusion engage with each other when the board connecting body of the board connector is inserted into the groove of the cable connector.

16. The connector module of claim 1, wherein a groove is formed inside the cable connecting body, and the plurality of contacts disposed on the front end of the flexible transmission unit is located in the groove so that the cable connecting body surrounds the plurality of contacts.

17. The connector module of claim 1, wherein the slot is formed on a top of the board connecting body, and at least one symbol is marked on the top of the board connecting body and located in a position adjacent to the slot.

18. The connector module of claim 17, wherein another symbol is marked on the cable connecting body and corresponding to the at least one symbol.

19. The connector module of claim 1, wherein the installation portion of the cable connecting body is a slit structure wherethrough the flexible transmission unit is inserted, a positioning portion is disposed in the slit structure, and two interfering portions are disposed on two sides of the flexible transmission unit and for interfering with the positioning portion, so as to fix the flexible transmission unit in the cable connecting body.

20. The connector module of claim 1, wherein a groove is formed inside the cable connecting body, and when the cable connector is connected with the board connector, the board connecting body of the board connector is inserted into the groove of the cable connector so that the cable connecting body surrounds the board connecting body and the resilient buckle.

* * * * *